US010621961B1

(12) United States Patent
Weld

(10) Patent No.: US 10,621,961 B1
(45) Date of Patent: Apr. 14, 2020

(54) SHELL FOR DRUMS AND OTHER MUSICAL INSTRUMENTS, AND THE METHOD OF MAKING THE SAME

(71) Applicant: Andrew J. Weld, Saint Paul, MN (US)

(72) Inventor: Andrew J. Weld, Saint Paul, MN (US)

( * ) Notice: Subject to any disclaimer, the term of this patent is extended or adjusted under 35 U.S.C. 154(b) by 0 days.

(21) Appl. No.: 16/518,982

(22) Filed: Jul. 22, 2019

Related U.S. Application Data

(60) Provisional application No. 62/702,343, filed on Jul. 23, 2018.

(51) Int. Cl.
*G10D 13/02* (2020.01)
*G10D 13/22* (2020.01)

(52) U.S. Cl.
CPC ..... *G10D 13/22* (2020.02)

(58) Field of Classification Search
None
See application file for complete search history.

(56) References Cited

U.S. PATENT DOCUMENTS 1,381,494 A * 6/1921 Olsen ..... G10D 13/028 84/411 R
3,227,197 A 1/1966 Sweet
4,219,060 A 8/1980 Hasegawa
4,522,006 A * 6/1985 Plikuhn ..... G10D 13/028 144/350
5,301,591 A * 4/1994 Greenberg ..... G10D 13/028 84/411 R
5,981,858 A * 11/1999 Jeng ..... G10D 13/028 84/104
6,380,468 B1 4/2002 Shigenaga
6,441,285 B1 * 8/2002 Kurosaki ..... G10D 13/028 84/411 R
6,792,727 B2 9/2004 Krieger
6,921,854 B2 7/2005 Gatzen
6,927,330 B2 8/2005 May
7,074,995 B2 7/2006 Barakat
7,148,413 B2 12/2006 May
(Continued)

OTHER PUBLICATIONS

Drum Building Methods; Retrieved from https://pdgood.us/drumshed/buildmethods.html on Apr. 12, 2019, 4 Pgs.
(Continued)

*Primary Examiner* — Robert W Horn
(74) *Attorney, Agent, or Firm* — Albert W. Watkins

(57) ABSTRACT

A drum shell with application to other musical instruments has a generally annular body defining a longitudinal axis, spaced opposed end surfaces, an interior generally cylindrical surface, and an exterior generally cylindrical surface. A plurality of longitudinally extensive kerfs extend generally parallel to the annular body longitudinal axis through the entire distance between the spaced opposed end surfaces. The kerfs are formed within the generally annular body. A drum head is stretched over a first one of the opposed end surfaces, and a fastener affixes the drum head to the drum shell. The annular body is formed from a flat substrate. To shape the flat substrate, a plurality of kerfs are cut in the substrate, and then the substrate is shaped into the annular configuration. In a most preferred embodiment, the kerfs are closed into a triangular tetrahedron during the shaping, and so form resonant bodies.

20 Claims, 6 Drawing Sheets

(56) References Cited

U.S. PATENT DOCUMENTS

| | | | | |
|---|---|---|---|---|
| 7,291,776 | B2 | 11/2007 | Dunnett | |
| 7,411,121 | B2 * | 8/2008 | McGill | G10D 3/06 84/267 |
| 7,446,250 | B1 * | 11/2008 | van der Meulen | G10D 13/028 84/411 R |
| 7,485,791 | B2 | 2/2009 | Takegawa | |
| 7,652,206 | B2 * | 1/2010 | Okamoto | G10D 13/028 84/411 R |
| 7,692,082 | B2 | 4/2010 | Abe | |
| 7,718,876 | B1 * | 5/2010 | Good | G10D 13/028 428/106 |
| 7,777,112 | B2 | 8/2010 | O'Connor | |
| 7,812,236 | B1 | 10/2010 | Good | |
| 8,035,018 | B2 * | 10/2011 | Bausch, III | G10D 13/028 84/411 R |
| 8,119,891 | B2 * | 2/2012 | Ryan | B27H 1/00 84/291 |
| 8,193,433 | B2 * | 6/2012 | Hong | G10D 13/028 84/411 R |
| 8,399,754 | B2 * | 3/2013 | Koks | G10D 13/028 84/411 R |
| 8,816,178 | B2 | 8/2014 | Gelb | |
| 8,853,514 | B2 | 10/2014 | Cox, Jr. | |
| 9,486,978 | B2 | 11/2016 | Chapman et al. | |
| 9,666,172 | B1 * | 5/2017 | Voelker | G10D 13/025 |
| 2008/0173158 | A1 * | 7/2008 | Lee | G10D 13/023 84/421 |

OTHER PUBLICATIONS

De Cristoforo, R. J., "How to Bend Wood with a Saw," Popular Science, Jan. 1958, pp. 186-189.

* cited by examiner

SHELL FOR DRUMS AND OTHER MUSICAL INSTRUMENTS, AND THE METHOD OF MAKING THE SAME

CROSS REFERENCE TO RELATED APPLICATIONS

The present application claims the benefit of U.S. provisional patent application 62/702,343 filed Jul. 23, 2018 of like title and inventorship, the teachings and entire contents which are incorporated herein by reference.

BACKGROUND OF THE INVENTION

1. Field of the Invention

The present invention pertains generally to the field of musical instruments, and more particularly to a shell used for drums, other percussion instruments, and other non-percussion musical instruments, and to the method of manufacture.

2. Description of the Related Art

Within the family of instruments used by musicians, there are a number of different types that are fabricated about a shell. For exemplary and non-limiting purpose, these may include percussion drums such as snare drums, bass drums, and tom-tom drums. The shell may be made from a variety of materials, including wood, metal, plastic, and fiberglass materials, or composites or laminates thereof.

Drum shells are manufactured using one of several common techniques. Most wooden shells are fabricated in a manner very similar to plywood, where a plurality of thin layers referred to as plies are stacked and shaped into a cylinder, typically using glue, heat, and compression molding to simultaneously form the plies to shape and to set the glue. This technique is also commonly used with combinations of laminates of wood plies with plies of other composition such as fiberglass, carbon, and plastics such as Kevlar™ and the like, or even with laminates made from fiberglass, carbon, and plastics such as Kevlar™ and the like, absent any wood.

Another technique for manufacturing wooden shells is to steam and then form a single solid ply or plank of wood into a cylinder, with a glue seam joining the ends into the cylinder. In a simplest construction, the glue line may be parallel to the longitudinal center of the cylinder, but this leads to a weaker shell. Consequently, in most common constructions the glue line will instead form at least a partial spiral about the longitudinal axis. Exemplary other known shell manufacturing techniques include: gluing and stacking a set of boards to form a polygon ring, followed by turning with a lathe to smooth the wood into a cylinder; and alternatively starting with a solid block of wood and using the lathe to form the entire cylinder.

Exemplary U.S. patents illustrating some of these various techniques, the teachings which are incorporated herein by reference, include: U.S. Pat. No. 5,981,858 by Jeng, entitled "Bamboo drum"; U.S. Pat. No. 6,441,285 by Kurosaki, entitled "Drum"; U.S. Pat. No. 7,446,250 by van der Meulen, entitled "Stave construction method of drum manufacture"; U.S. Pat. No. 7,652,206 by Okamoto, entitled "Drum and manufacturing method of cylinder thereof"; U.S. Pat. No. 7,718,876 by Good, entitled "Angled grain drum shell ply configuration"; U.S. Pat. No. 7,812,236 by Good, entitled "One-piece wooden drum shell formation"; and U.S. Pat. No. 8,399,754 by Koks, entitled "Musical instrument with a head tensioned over a shell by a rim using an axially oriented grain structure".

As may be appreciated, each material and method of fabrication brings out different sounds or tonal qualities. Depending upon the drummer and type of sound desired, one or another of these shell materials may be preferred, and a particular manufacturing technique may also be preferred.

In addition to the various manufacturing techniques, a drum also may be intentionally altered to modify the acoustic characteristics. One approach is to incorporate one or more acoustic vents at particular locations within the shell. Exemplary U. S. patents, the teachings which are incorporated herein by reference, include: U.S. Pat. No. 6,927,330 by May, entitled "Drum with modulated acoustic air vent"; U.S. Pat. No. 7,148,413 by May, entitled "Drum with modulated acoustical air vent"; U.S. Pat. No. 7,291,776 by Dunnett, entitled "Adjustable venturi for a drum"; U.S. Pat. No. 7,485,791 by Takegawa, entitled "Golden ratio air vent holes"; U.S. Pat. No. 7,692,082 by Abe, entitled "Drum"; U.S. Pat. No. 8,035,018 by Bausch, entitled "Vertically vented drum shell"; U.S. Pat. No. 8,816,178 by Gelb, entitled "System of removing overtones and rings in a drum set"; and U.S. Pat. No. 8,853,514 by Cox, entitled "Wood stave drum with opto/acoustic shell windows".

There are a variety of other techniques that have been devised to alter the acoustic characteristics of a drum shell, beyond acoustic vents. Exemplary U.S. patents, the teachings which are incorporated herein by reference, include: U.S. Pat. No. 6,380,468 by Shigenaga, entitled "Drum having shell consisting of more than one kind of vibratory element arranged in parallel with respect to skin"; U.S. Pat. No. 6,921,854 by Gatzen, entitled "Grooved drum body construction"; U.S. Pat. No. 7,074,995 by Barakat, entitled "Unique sounding drum"; and U.S. Pat. No. 7,777,112 by O'Connor, entitled "Method and apparatus for tuning a musical drum".

Additional patents of varying relevance, the relevant teachings and contents which are incorporated herein by reference, include: U.S. Pat. No. 3,227,197 by Sweet, entitled "Combining cutting and bending in sawing wood"; U.S. Pat. No. 4,219,060 by Hasegawa, entitled "Method of and apparatus for tenderizing veneer"; U.S. Pat. No. 6,792,727 by Krieger, entitled "Curved wall panel system"; and U.S. Pat. No. 9,486,978 by Chapman et al, entitled "Systems and methodsfor Kerfing veneers".

In addition to the foregoing patents, Webster's New Universal Unabridged Dictionary, Second Edition copyright 1983, is incorporated herein by reference in entirety for the definitions of words and terms used herein.

While each of these different manufacturing techniques and acoustic modifications alter the sound of the drum shell, the alterations are not always pleasing to the ear. A common and undesirable side effect of many alterations is an unwanted strong resonance at one or more frequencies, which can result in a harsher sound and much more limited tuning capability. Further, many of these techniques are either extremely labor intensive, or subject to premature failure during use or transport of the drum shell. As may be apparent, in spite of the enormous advancements and substantial research and development that has been conducted, there still remains a need for a more readily manufactured drum shell which provides a flatter frequency response, while still preserving both sensitivity and durability of the drum assembly.

SUMMARY OF THE INVENTION

In a first manifestation, the invention is a drum. A drum shell has a generally annular body defining a longitudinal axis, spaced opposed end surfaces, an interior generally cylindrical surface, and an exterior generally cylindrical surface. A plurality of longitudinally extensive kerfs extend generally parallel to the annular body longitudinal axis through the entire distance between the spaced opposed end surfaces. The kerfs are formed within the generally annular body. A drum head is stretched over a first one of the opposed end surfaces. A fastener affixes the drum head to the drum shell.

In a second manifestation, the invention is a shell for a musical instrument. A generally annular body defines a longitudinal axis, spaced opposed end surfaces, an interior generally cylindrical surface, and an exterior generally cylindrical surface. A plurality of longitudinally extensive kerfs extend generally parallel to the annular body longitudinal axis the entire distance between the spaced opposed end surfaces. The kerfs also extend from the annular body interior generally cylindrical surface radially toward the annular body exterior generally cylindrical surface, and the kerfs are formed within the generally annular body. The plurality of longitudinally extensive kerfs comprise a void in the annular body and define openings at each spaced opposed end surface.

In a third manifestation, the invention is a method of manufacturing a shell for a musical instrument. The method comprises the steps of: forming a plurality of kerfs in a flat substrate; and bending the flat substrate to form an annular body and simultaneously close the plurality of kerfs adjacent to an interior of the annular body, and thereby form hollow resonant bodies within the annular body.

OBJECTS OF THE INVENTION

Exemplary embodiments of the present invention solve inadequacies of the prior art by providing an annular body formed from a flat substrate. To shape the flat substrate, a plurality of kerfs are cut in the substrate, and then the substrate is shaped into the annular configuration. In a most preferred embodiment, the kerfs are closed into a triangular tetrahedron, or prism, during the shaping, and so form resonant bodies. The annular body in a most preferred embodiment defines a drum shell.

The present invention and the preferred and alternative embodiments have been developed with a number of objectives in mind. While not all of these objectives are found in every embodiment, these objectives nevertheless provide a sense of the general intent and the many possible benefits that are available from embodiments of the present invention.

A first object of the invention is to provide a readily manufactured high quality drum shell. A second object of the invention is to preserve both sensitivity and durability of the drum. Another object of the present invention is to provide a flatter frequency response than generally available in the prior art, to produce an easier to tune, more consistent instrument. A further object of the invention is to enable ready acoustic customization using a variety of similarly easily manufactured and durable variants from the preferred embodiment drum.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

Figure 1:
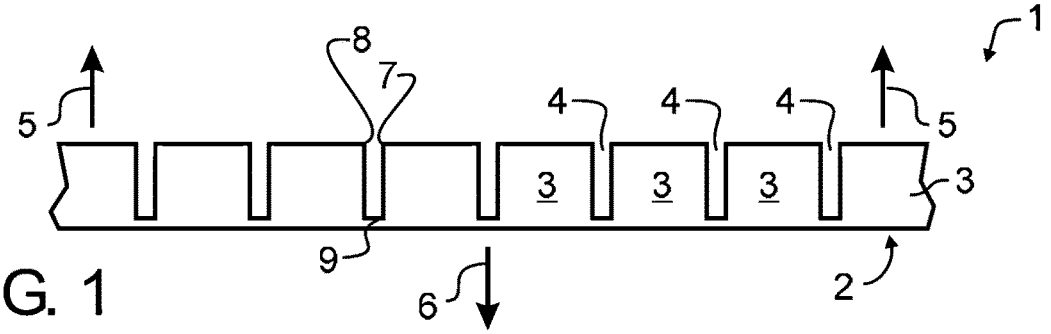
FIG. 1 illustrates a preferred embodiment shell for drums and other musical instruments designed in accord with the teachings of the present invention in a partially manufactured planar configuration from side view.

In a partially manufactured planar configuration illustrated in FIG. 1, preferred embodiment shell 1 is comprised of a wooden body 2, which may comprise any suitable species of wood. Exemplary species include maple, birch, and mahogany, but the invention is not solely limited thereto.

Wooden body 2 is preferably selected to be a single solid ply of dry wood. The wood will preferably be generally clear and free of substantial defects such as knots and the like that might lead to premature failure or undesirable alteration of sound. In alternative embodiments contemplated herein, certain defects in the wood may be specifically selected or formed in the wood to create further custom sounds unique to a particular shell, if so desired. Nevertheless, any such defect must not prevent at least one of the preferred and alternative embodiments of manufacture described herein below from being implemented.

In the preferred embodiment, wooden body 2 is preferably machined such as by sawing to form a plurality of parallel and equidistantly spaced saw kerfs 4. Any suitable saw may be used, including for exemplary and non-limiting purpose a single blade band saw or circular saw, or even multiple blade saws such as a plurality of circular saws affixed to a common rotary shaft, or ganged-together band saws. While sawing is preferred, it will be apparent that other techniques, for exemplary and non-limiting purposes such as routing and milling, again with single or ganged together blades, may also be used to form kerfs 4. The formation of these parallel kerfs 4 defines a plurality of teeth 3, and also defines opposed and facing interior corners 7, 8 of teeth 3. In addition, the bottom 9 of kerf 4 defines a minimum thickness of wooden body 2 adjacent thereto.

While in the preferred embodiment the kerfs are parallel and equidistantly spaced, in some alternative embodiments, the kerfs are not equidistantly spaced. In yet other alternative embodiments, the kerfs are not parallel. Altering the kerf spacing and orientation can be used in alternative embodiments to alter the sound produced by shell 1.

Once the desired kerfs 4 are formed in wooden body 2, then wooden body 2 may be bent to form preferred embodiment shell 1. The distal ends of wooden body 2 are preferably pulled in the direction identified by arrows 5 in FIG. 1, while the central portion of wooden body 2 is preferably pulled in a generally opposite direction identified by arrow 6. Most preferably this bending in the opposite directions of arrows 5 and 6 is continued until wooden body 2 is pulled into the generally cylindrical geometry illustrated in FIG. 2.

Figure 2:
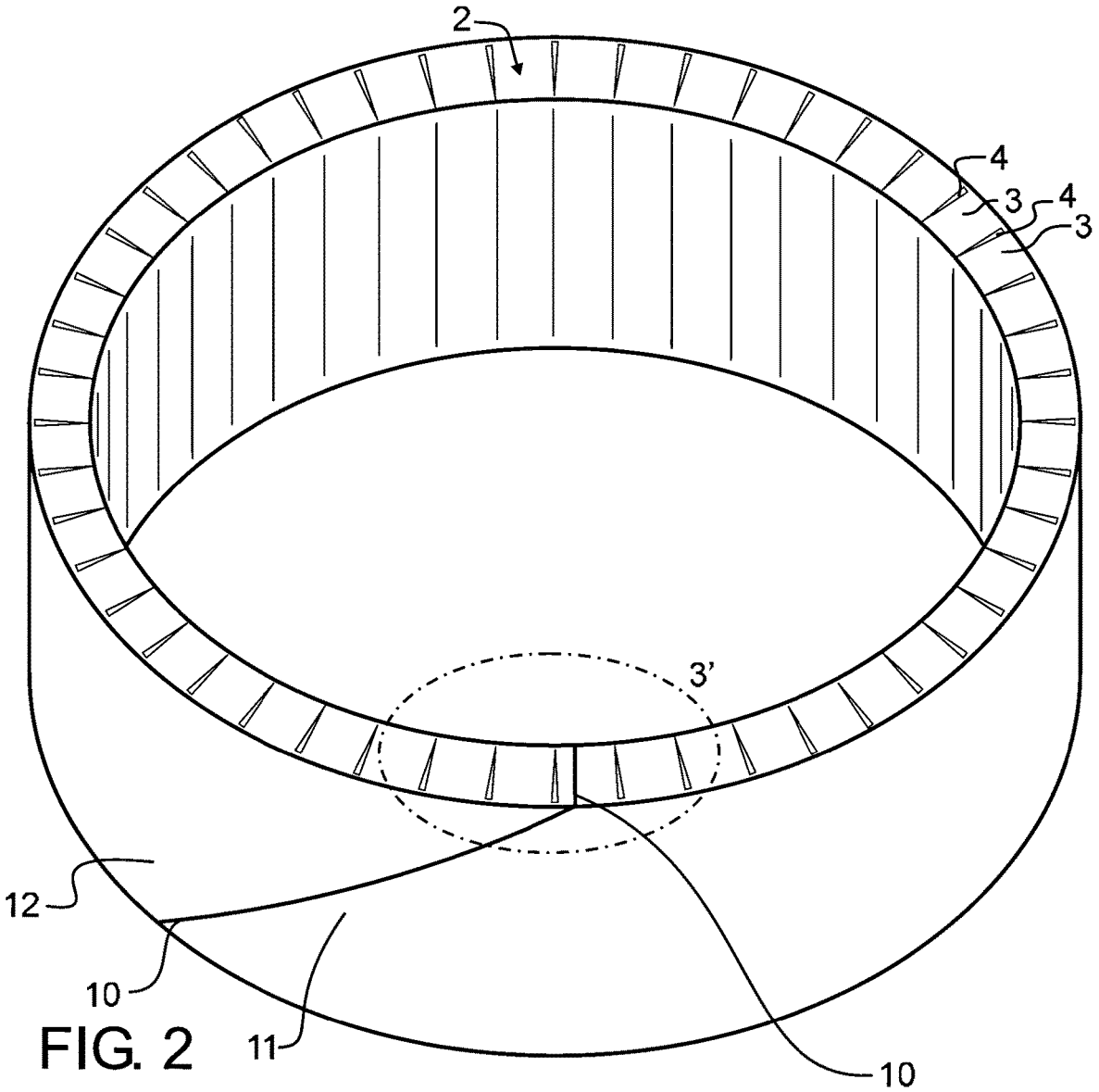
FIGS. 2 and 3 illustrate a preferred embodiment shell manufactured from the planar form illustrated in FIG. 1 and designed in accord with the teachings of the present invention from projected and enlarged projected views, respectively.
Figure 3:
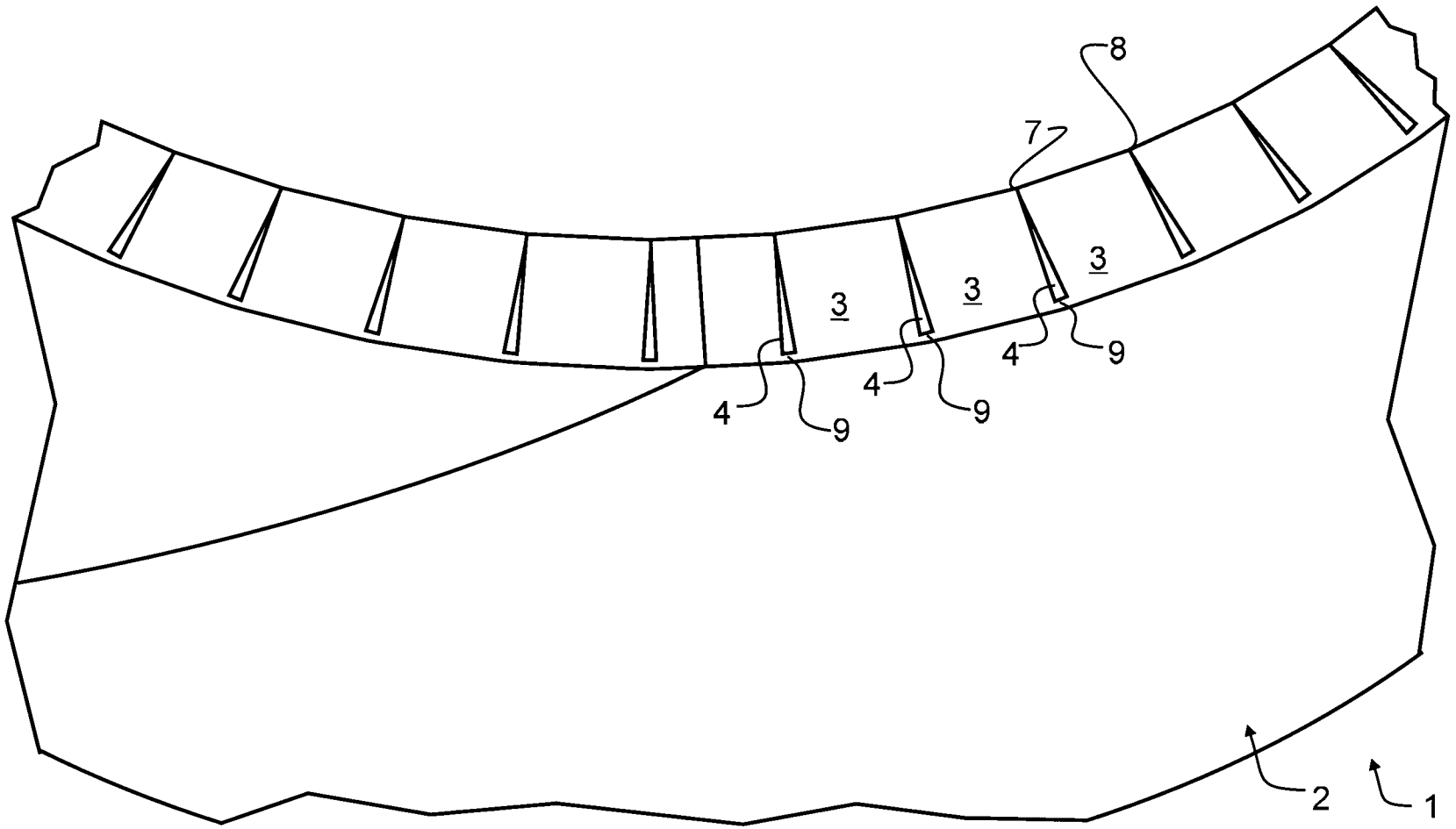

As visible in FIGS. 2-3, in a most preferred embodiment of the present invention, the width of kerfs 4 are chosen such that when the distal ends 11, 12 of wooden body 2 come together, the opposed and facing interior corners 7, 8 of teeth 3 will also come into contact with each other. As may be apparent then, for example from FIG. 3, teeth 3 are radially inward extensive, but are rigidly anchored both at the radially outer edge by wood adjacent to bottom 9, and are rigidly anchored at the radially inner edge by the compression contact between opposed and facing interior corners 7, 8 of teeth 3.

This anchoring of both the radially inner and outer edges of teeth 3 provides several benefits. The strength and rigidity of the resulting preferred embodiment shell 1 is greater than if opposed and facing interior corners 7, 8 did not contact each other. This permits the depth of kerfs 4 to be substantial, with very little wood remaining between the bottom 9 of each kerf 4 and the outer perimeter of wooden body 2. As a result, each individual kerf 4 becomes a closed and hollow body that extends longitudinally from top edge to bottom edge of preferred embodiment shell 1.

While not being bound solely to any theory, these closed and hollow bodies formed from the closing of each kerf 4 at opposed and facing interior corners 7, 8 also form small resonance chambers that are believed to interact with the resonance of wooden body 2 to produce a unique sound that to at least some musicians is superior to the sound produced by the prior art. The voids defined by kerfs 4 are approximately in the shape of a triangular prism.

In alternative embodiments, the width of kerf 4 may be adjusted to create a desired resonance and acoustic result. In a further alternative embodiment, the width of kerf 4 may be varied from kerf to kerf, to further create and adjust a desired resonance and acoustic result. In yet further alternative embodiments, additional material(s) may be provided within or adjacent to opposed and facing interior corners 7, 8 of teeth 3 including but not limited to various adhesives, polymers, films, laminates and the like.

While the formation of kerfs 4 using one or a bank of saw blades is most preferred owing to the relative speed and simplicity of formation, alternative techniques may be used.

In one alternative embodiment, rather than forming a kerf 4, longitudinally extensive holes may be drilled or otherwise formed within wooden body 2 that may be of consistent diameter. In such instances, the geometry of the holes will differ from the triangular prism of the preferred embodiment shell 1, and may instead be cylindrical.

Figure 4:
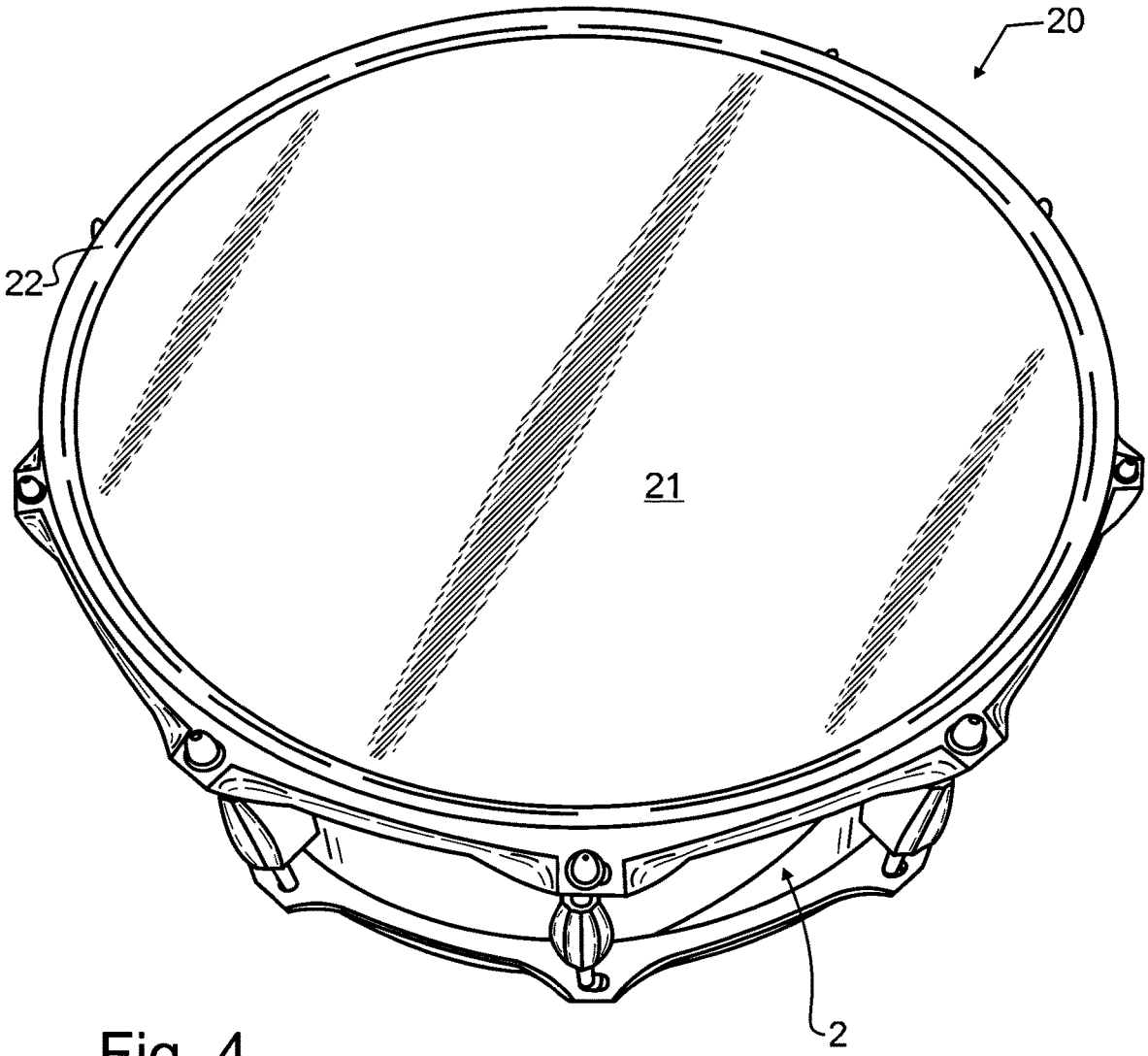
FIG. 4 illustrates a preferred combination of the shell illustrated in FIGS. 2-3 with additional commercially available drum components from projected view.

While the method and apparatus used to affix distal ends 11, 12 of wooden body 2 together is not critical to the operation of the present invention, and so any suitable known technique will be considered to be incorporated herein, in preferred embodiment shell 1 the distal ends 11, 12 are secured together at a helically extending glue line 10 best visible in FIG. 4. In addition, as known in the drum art and where desired or appropriate, one or more ports optionally may be provided passing entirely through wooden body 2 from an exterior of shell 1 to an interior thereof. Further, while the wooden body 2 is illustrated as being of constant thickness, in some alternative embodiments sections of different thickness may be provided such as near the ends of the annular body. In such cases, the width of the kerf may also be adjusted in those regions of differing thickness.

FIG. 4 illustrates a preferred combination of the shell illustrated in FIGS. 2-3 with additional commercially available drum components from a projected view. These prior art drum components may for exemplary and non-limiting purpose include drum head(s) 21, rim(s) 22, tension rods, snares and the like. A drum stand may further optionally be provided.

Figure 5:
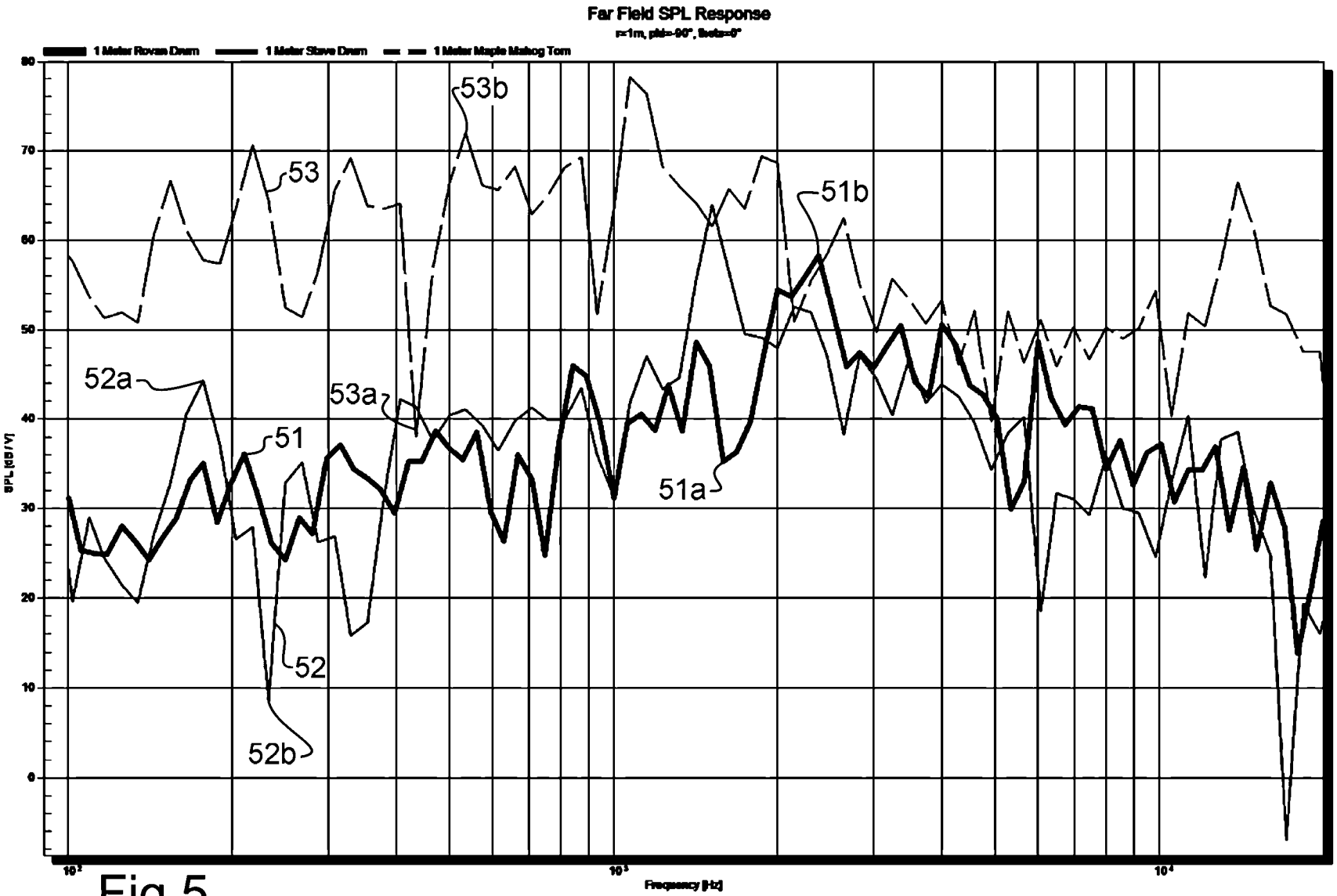
FIG. 5 illustrates a graph of the far field SPL response across a wide frequency sweep for each of the preferred drum illustrated in FIG. 4, a commercially available stave drum, and a commercially available wooden laminate drum.

FIG. 5 illustrates a graph of the far field Sound Pressure Level (SPL) response across a wide frequency sweep between 100 Hz and 20 KHz for each of the preferred embodiment drum 20 illustrated in FIG. 4 as plot 51, a commercially available stave drum as plot 52, and a commercially available wooden laminate drum as plot 53. While the prior art wooden laminate drum has an overall higher far field SPL level than either the prior art stave drum or the preferred embodiment drum 20, suggesting the thinner laminate is easier and more efficient to acoustically excite, as would be expected. However, upon closer inspection, both the prior art stave drum and prior art wooden laminate drum also have much greater deviation between local peak responses and local minimum responses. This can be observed by the deviation between local minimum point 53*a* and local maximum 53*b*, which deviate far more from each other than the local minimum 51*a* and local maximum 51*b*. Likewise, local minimum 52*b* and maximum 52*a* also deviate far more from each other than the local minimum 51*a* and local maximum 51*b*. In other words, the response is much flatter and more consistent in the preferred embodiment drum 20.

There are several very important acoustic benefits to the flatter and more consistent response provided by the preferred embodiment drum 20. A drum 20 assembled using the preferred embodiment shell 1 is much easier to tune, being more consistent across the frequency spectrum, and more consistent in performance at a selected drum head resonance. As a result, the drum is more versatile than either of the prior art constructions. The resulting tonal quality of drum 20 may be described as dry, crisp, and sensitive, whereas for exemplary purpose the prior art stave construction can be described as tubby or hollow.

Figure 6:
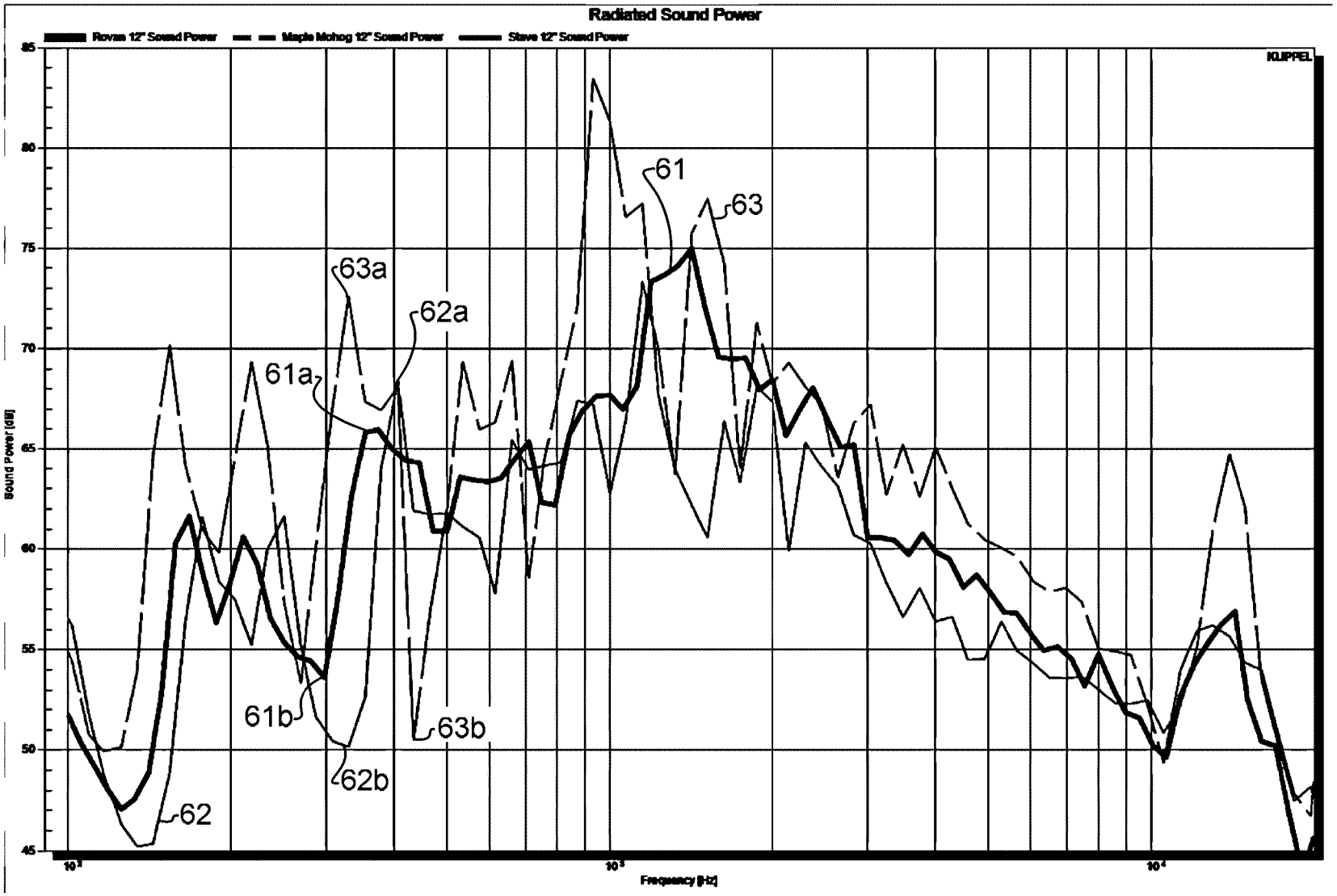
FIG. 6 illustrates a graph of the radiated sound power response across a wide frequency sweep for each of the preferred drum illustrated in FIG. 4, a commercially available stave drum, and a commercially available wooden laminate drum.

FIG. 6 illustrates a graph of the radiated sound power response across a wide frequency sweep for each of the preferred embodiment drum 20 illustrated in FIG. 4 as plot 61, a commercially available stave drum as plot 62, and a commercially available wooden laminate drum as plot 63.

Very similar to the plots of FIG. 5, both the prior art stave drum and prior art wooden laminate drum have much greater deviation between local peak responses and local minimum responses in radiated sound power. This can be observed by the deviation between local minimum point 63*b* and local maximum 63*a*, which deviate far more from each other than the local minimum 61*b* and local maximum 61*a*. Likewise, local minimum 62*b* and maximum 62*a* also deviate far more from each other than the local minimum 61*b* and local maximum 61*a*. This plot similarly confirms that the response is much flatter and more consistent in the preferred embodiment drum 20.

From the foregoing figures and description, several additional features and options become more apparent. First of all, preferred embodiment shell 1 may be manufactured from a variety of materials, including not only single ply wood, but also various wood laminates, metals, resins and plastics, ceramics or cementitious materials, or even combinations, composites, or laminates of the above. The specific material used may vary to meet the acoustic needs or desires of a musician or designer.

Figure 7:
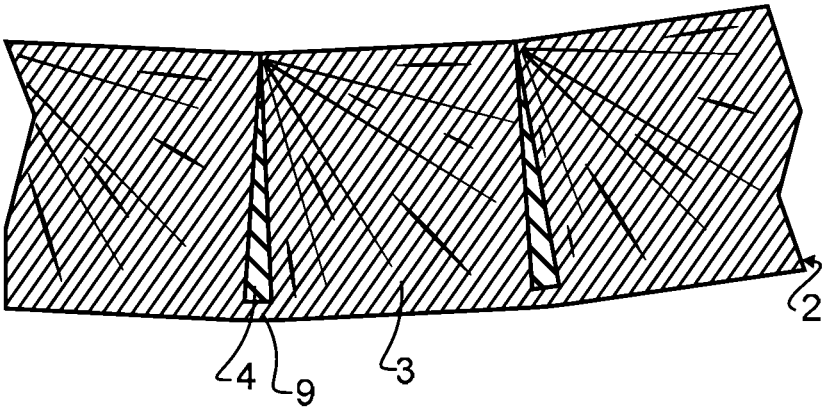
FIG. 7 illustrates a first alternative embodiment shell manufactured from the planar form illustrated in FIG. 1, and in further combination with a kerf filler material, from a sectional view taken from a plane transverse to the shell longitudinal axis.
Figure 8:
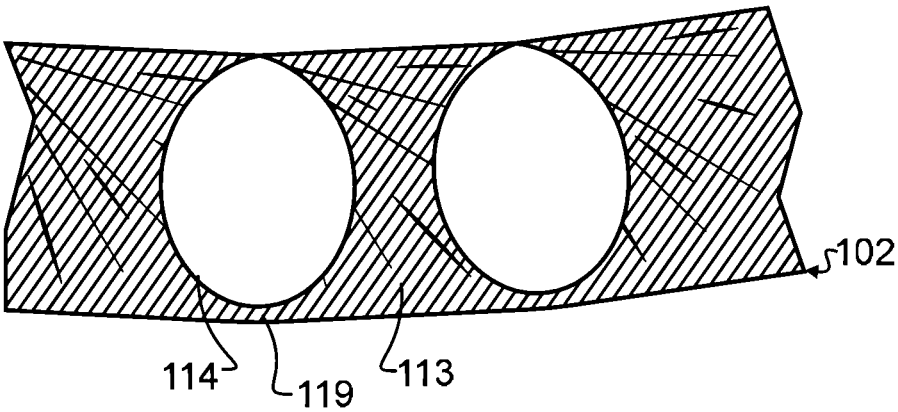
FIG. 8 illustrates a second alternative embodiment shell manufactured from the planar form similar to that illustrated in FIG. 1, but with drilled holes rather than a saw kerf, from a sectional view taken from a plane transverse to the shell longitudinal axis.
Figure 9:
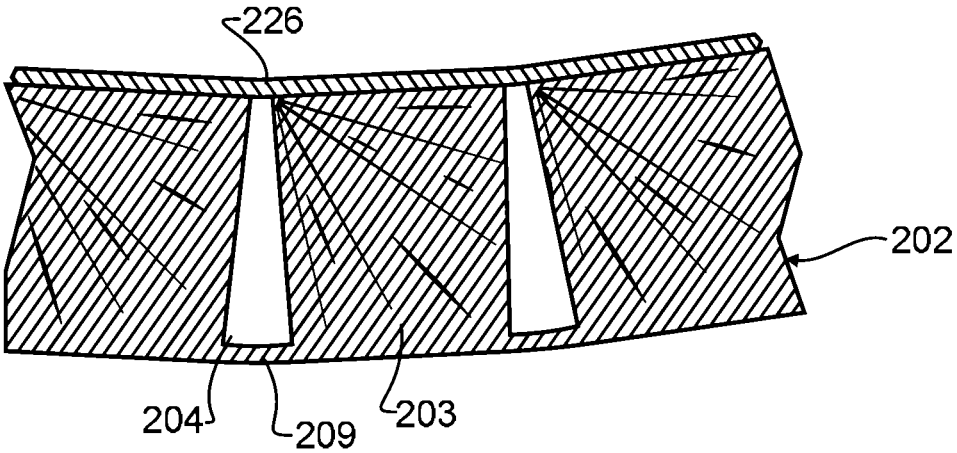
FIG. 9 illustrates a third alternative embodiment shell manufactured from the planar form similar to that illustrated in FIG. 1, but with a wider saw kerf only partially closed, and with a sheet completing the closure, from a sectional view taken from a plane transverse to the shell longitudinal axis.

Various embodiments of apparatus designed in accord with the present invention have been illustrated in FIGS. 7-9. The embodiments are distinguished by the hundreds digit, and various components within each embodiment designated by the ones and tens digits. However, many of the components are alike or similar between embodiments, so numbering of the ones and tens digits have been maintained wherever possible, such that identical, like or similar functions may more readily be identified between the embodiments. If not otherwise expressed, those skilled in the art will readily recognize the similarities and understand that in many cases like numbered ones and tens digit components may be substituted from one embodiment to another in accord with the present teachings, except where such substitution would otherwise destroy operation of the embodiment. Consequently, those skilled in the art will readily determine the function and operation of many of the components illustrated herein without unnecessary additional description.

In some alternative embodiments kerfs 4 may also further be filled with a filler material. In some alternative embodiments, a filler may provide different acoustic characteristic from that of wooden body 2 that may or may not also differ acoustically from the voids created within kerf 4 in preferred embodiment shell 1. FIG. 7 illustrates a first alternative embodiment shell manufactured from the planar form illustrated in FIG. 1, and in further combination with a kerf filler material. Rather than an empty kerf 4, a filler material has been inserted or injected therein. The composition of the filler material may be varied to define a particular desired acoustic characteristic.

In further alternative embodiments, again for exemplary and non-limiting purpose, the holes may take on the geometry of a truncated cylinder, wherein the holes are formed with a longitudinal axis still within wooden body, but offset toward the longitudinal center of shell 1 such that the drill cuts a void extending or opening into the inner perimeter. In such embodiment, opposed and facing interior corners 7, 8 will still be formed, and bending may take place as described herein above to convert from a planar wood ply into a shell. FIG. 8 illustrates a second alternative embodiment annular body manufactured from the planar form similar to that illustrated in FIG. 1, but with drilled holes rather than a saw kerf.

In a further alternative embodiment, the plurality of holes may be comprised by a plurality of different diameters. In further alternative embodiments, the radial distance of the holes relative to the central longitudinal axis may also be varied.

In yet further alterative embodiments, particularly where kerfs 4 are milled or routed, the internal geometry of the kerf may be varied by the geometry of the router or mill bit. In many of these alternative embodiments, opposed and facing interior corners 7, 8 will still be formed, and bending may take place as described herein above to convert from a planar wood ply into a shell.

In yet further alterative embodiments, the kerf may be cut wider than required to produce a given diameter annular body. In such instance, a separate sheet, which may comprise a film, laminate, wooden ply, or other suitable material may be formed as a liner within the interior of the annular body 2. FIG. 9 illustrates a third alternative embodiment annular body 202 manufactured from the planar form similar to that illustrated in FIG. 1, but with a wider saw kerf only partially closed, and with a sheet 226 completing the closure.

As may be appreciated, each of these alternative embodiments may also be used to create and adjust a desired resonance and acoustic result.

While the foregoing details what is felt to be the preferred and additional alternative embodiments of the invention, no material limitations to the scope of the claimed invention are intended. For exemplary and non-limiting purpose, while the preferred embodiment has been disclosed for application with drums and other musical instruments, the present invention is not so limited, and also may be applied to other acoustic apparatus as well. As may be appreciated, the variants that would be possible from a reading of the present disclosure are too many in number for individual listings herein, though they are understood to be included in the present invention. Further, features and design alternatives that would be obvious to one of ordinary skill in the art are considered to be incorporated herein. The scope of the invention is set forth and particularly described in the claims herein below.

I claim:

1. A drum, comprising:

a drum shell having a generally annular body defining a longitudinal axis, spaced opposed end surfaces, an interior generally cylindrical surface, and an exterior generally cylindrical surface;

a plurality of longitudinally extensive kerfs extending generally parallel to said annular body longitudinal axis the entire distance between said spaced opposed end surfaces and formed within said generally annular body;

a drum head stretched over a first one of said opposed end surfaces; and a fastener affixing said drum head to said drum shell.

2. The drum of claim 1, wherein said generally annular body further comprises a single ply of wood.

3. The drum of claim 1, wherein said plurality of longitudinally extensive kerfs comprise a void in said drum shell annular body defining openings at each spaced opposed end surface.

4. The drum of claim 1, wherein said plurality of longitudinally extensive kerfs extend from said drum shell interior generally cylindrical surface radially toward said drum shell exterior generally cylindrical surface.

5. The drum of claim 4, wherein said plurality of longitudinally extensive kerfs are compressively closed adjacent to said drum shell interior generally cylindrical surface.

6. The drum of claim 5, wherein said plurality of longitudinally extensive kerfs further comprise independent resonance chambers that interact with the resonance of said drum shell annular body.

7. The drum of claim 1, wherein said plurality of longitudinally extensive kerfs further comprise a generally triangular cross-section when sectioned by a plane transverse to said annular body longitudinal axis.

8. The drum of claim 1, wherein individual ones of said plurality of longitudinally extensive kerfs further comprise a cross-section different from other ones of said plurality of longitudinally extensive kerfs.

9. The drum of claim 1, further comprising a filler material of composition different from said drum shell annular body, said filler material filling at least one of said plurality of longitudinally extensive kerfs.

10. The drum of claim 1, further comprising a sheet affixed to said interior generally cylindrical surface.

11. The drum of claim 10, wherein said sheet at least partially encloses at least one of said plurality of longitudinally extensive kerfs.

12. The drum of claim 4, wherein said plurality of longitudinally extensive kerfs are adhesively closed adjacent to said drum shell interior generally cylindrical surface.

13. A shell for a musical instrument, comprising:

a generally annular body defining a longitudinal axis, spaced opposed end surfaces, an interior generally cylindrical surface, and an exterior generally cylindrical surface; and a plurality of longitudinally extensive kerfs extending generally parallel to said annular body longitudinal axis the entire distance between said spaced opposed end surfaces and extending from said annular body interior generally cylindrical surface radially toward said annular body exterior generally cylindrical surface and formed within said generally annular body, said plurality of longitudinally extensive kerfs comprising a void in said annular body and defining openings at each spaced opposed end surface.

14. The shell of claim 13, wherein said plurality of longitudinally extensive kerfs are compressively closed adjacent to said drum shell interior generally cylindrical surface.

15. The shell of claim 14, wherein said plurality of longitudinally extensive kerfs further comprise independent resonance chambers that interact with the resonance of said drum shell annular body.

16. The shell of claim 13, further comprising a filler material of composition different from said drum shell annular body, said filler material filling at least one of said plurality of longitudinally extensive kerfs.

17. The shell of claim 13, further comprising a sheet affixed to said interior generally cylindrical surface, said sheet at least partially enclosing at least one of said plurality of longitudinally extensive kerfs.

18. The shell of claim 13, wherein said plurality of longitudinally extensive kerfs are adhesively closed adjacent to said drum shell interior generally cylindrical surface.

19. A method of manufacturing a shell for a musical instrument, comprising the steps of:

forming a plurality of kerfs in a flat substrate; and bending the flat substrate to form an annular body and simultaneously close said plurality of kerfs adjacent to an interior of said annular body and thereby form hollow resonant bodies within said annular body.

20. The method of manufacturing a shell for a musical instrument of claim 1, further comprising the step of filling said plurality of kerfs with a filler material.

* * * * *